United States Patent [19]

Chan et al.

[11] 4,179,037

[45] Dec. 18, 1979

[54] XENON ARC LAMP WITH COMPRESSIVE CERAMIC TO METAL SEALS

[75] Inventors: Edwin T. Chan, Sunnyvale; Stanley R. Jepson, Campbell, both of Calif.

[73] Assignee: Varian Associates, Inc., Palo Alto, Calif.

[21] Appl. No.: 906,371

[22] Filed: May 15, 1978

Related U.S. Application Data

[63] Continuation of Ser. No. 767,854, Feb. 11, 1977, abandoned.

[51] Int. Cl.[2] ..... H01K 1/36

[52] U.S. Cl. ..... 220/2.3 R; 313/113; 313/205; 313/220

[58] Field of Search ..... 220/2.3 R, 2.3 A, 75; 313/110, 113, 114, 184, 220, 221, 204, 205, 240, 285, 317, 493; 174/17 GF, 17.05, 50.54, 50.57

[56] References Cited

U.S. PATENT DOCUMENTS

| | | | |
|---|---|---|---|
| 2,513,920 | 7/1950 | De Walt | 220/2.3 R X |
| 2,677,781 | 5/1954 | Drieschmann | 220/2.3 R X |
| 3,458,744 | 7/1969 | Sowers et al. | 313/220 X |
| 3,551,719 | 12/1970 | Peacher et al. | 313/220 X |
| 3,715,613 | 2/1973 | Parkman | 313/220 X |
| 3,808,496 | 4/1974 | McRae et al. | 313/220 X |

*Primary Examiner*—Stephen Marcus

*Attorney, Agent, or Firm*—Stanley Z. Cole; Leon F. Herbert; Edward H. Berkowitz

[57] ABSTRACT

A high pressure arc lamp envelope having an anode portion and cathode portion, separated by a ceramic insulator, is configured to prevent the high pressure from causing tensile stresses in the ceramic and its associated hermetic seals. The window seal is configured to reduce tensile stresses in the window and to place the metal-to-window bond of the seal in compression.

14 Claims, 3 Drawing Figures

XENON ARC LAMP WITH COMPRESSIVE CERAMIC TO METAL SEALS

This is a continuation of application Ser. No. 767,854 filed Feb. 11, 1977, now abandoned.

BACKGROUND OF THE INVENTION

This invention relates to high pressure gaseous discharge devices and in particular to improvements in the envelope structure and window seal for high pressure arc lamps.

In any arc lamp, various portions of the lamp structure will be at different potentials corresponding to one or another electrode. It is necessary, therefore, to provide insulation between these portions in order to maintain their mutual electrical isolation. Prior art high pressure arc lamps, for example, as described in U.S. Pat. Nos. 3,876,908; 3,852,629; and 3,808,496, employ ceramic cylinders separating the lamp envelope into anode and cathode portions with a circumferential surface of the insulator as part of the lamp envelope exterior. It will be apparent that as a consequence of this construction, the lamp design, operation and usage are subject to a number of critical specifications.

One such critical specification is related to the internal pressure and temperature to which the ceramic and the ceramic to metal bonds are subject. Ceramic cylinders or rings so employed are primarily under tensile stresses due to the high pressure gas filling of the lamp which tends to push apart the anode and cathode portions of the lamp envelope. The brazed metal to ceramic bonds of these prior art lamps are likewise under tensile or shear stress. Due to the properties of the brazing alloys and the metallic members, the stresses within the joint must be maintained within safe tolerances. These stresses are thermally dependent and thus place limits on the lamp operation and associated cooling system.

Another critical consideration is the ambient environment wherein the lamp will be operated. Moisture, dirt, grease, fingerprints and the like can seriously degrade the insulation characteristics of the ceramic, especially for high voltage starting conditions. Moreover, the exposed ceramic is subject to impact which can initiate a fracture thereof.

It will be clear also that failure of the ceramic or the metal-ceramic seals of a high pressure lamp can be hazardous to personnel or equipment nearby.

Another prior art arc lamp, described in U.S. Pat. No. 3,715,613, employed a ceramic cylinder with a recessed plane surface for accepting a metal disk which in turn supported the anode structure. The outside surface of the ceramic was brazed to the inner surface of the envelope neck. Thus, the metal ring exerted compressive and shear stresses at one end of the ceramic due to the internal gas pressure while a brazement of the outer circumferential wall of the ceramic to the inner cylindrical surface of the envelope neck resulted in shear stresses due to the internal gas pressure.

An arc lamp is also characterized by an optical window which must withstand a very great pressure differential between the interior and exterior of the lamp. Prior art window seals in such lamps have normally employed a window disc of sapphire, metallized around its circumference and then brazed to one leg of a U-shaped metal flange, which was subsequently brazed into the window-cathode portion assembly, as shown for example in U.S. Pat. No. 3,852,629. This window sealing technique resulted in an improved seal but one which is not as good as the seal to be hereinafter described with respect to this invention.

SUMMARY OF THE INVENTION

The present invention provides a body seal of geometry which places the main body ceramic insulator and its associated brazement in compression. This is accomplished by placing the ceramic insulator between the radially outward projecting flange of an inner cylindrical portion of the lamp body and a radially inward projecting flange of an outer cylindrical portion of the lamp body. The cylindrical portions are coaxial and overlap each other, and the internal gas pressure in the envelope exerts compressive forces on the ceramic. The present invention also applies compressive stresses across the metal-sapphire bond of the window seal and across the thickness of the window itself by sealing an annular portion of the outer plane face of the window to an intermediate ring using a knife edge brazement and then edge brazing the ring to the outer envelope. For the purposes of this specification a knife edge sealing member is one wherein the ratio of length to thickness of such member is 5 or more, not necessarily sharp edged.

It is an object of this invention to produce a safer and more rugged lamp capable of both higher performance and production at reduced manufacturing cost.

In one feature of the invention, the anode and cathode portions of the lamp envelope are separated by a ceramic insulator inserted between an inwardly projecting flange of said cathode portion and an outwardly projecting flange of said anode portion whereby said insulator is subject primarily to compressive stresses.

In another feature of the invention, plane surfaces of the ceramic insulator for electrical isolation of anode from cathode are adapted for brazing to knife edge seals, whereby preparation of radial surfaces for sealing may be avoided.

In another feature of the invention, the ceramic insulator is substantially enclosed by said envelope portions whereby said insulator is protected from impact or from contamination of its surface.

In another feature of the invention, the window is hermetically sealed to a body portion of the lamp envelope by face brazing the external plane surface of the window to a knife edge surface of a Kovar ring, and by brazing the other knife edge surface of said Kovar ring to an inwardly projecting lip of the lamp envelope.

DETAILED DESCRIPTION OF THE INVENTION

Figure 1:
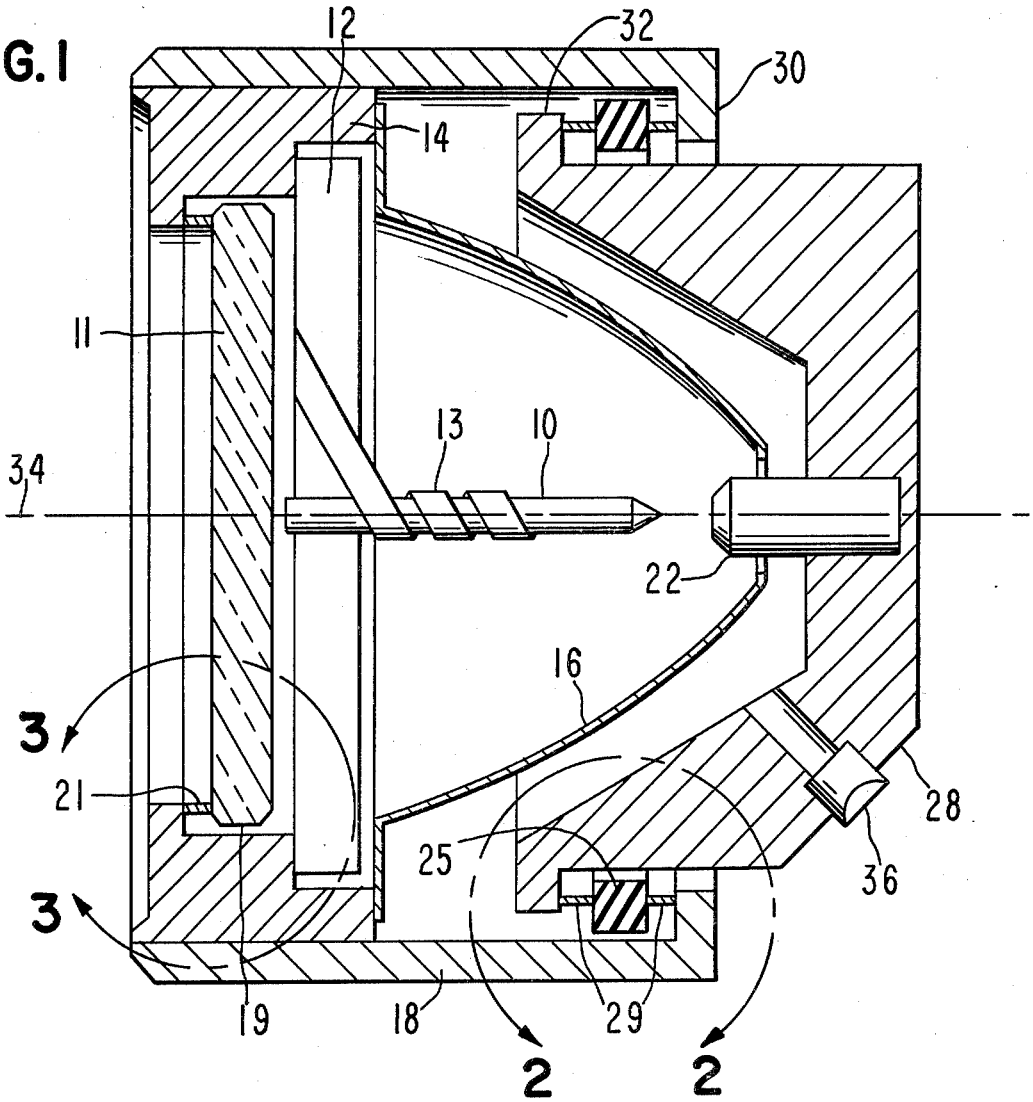
FIG. 1 is a section of an embodiment of the high pressure arc lamp of the present invention.

FIG. 1 is illustrative of a high pressure sealed beam short arc lamp of the present invention. One electrode shown as cathode 10 is mounted in the forward part of the lamp adjacent to window 11. Cathode 10 is supported by metal struts 12 which are centrally attached to cathode 10. A getter 13 is provided to remove contaminants from the gas filling of the lamp. The struts 12 are attached to metal ring 14 adjacent the outer ends of the struts. Reflector 16 is suspended from ring 14. The exterior of the forward portion of the lamp is a cylindrical shell 18 made of a high strength metallic alloy, such as stainless steel.

Window 11, preferably of sapphire, is face brazed with a knife edge braze process to annular sealing ring 21, the latter preferably of Kovar.

Although the window 11 remains subject to the same bending moment across its plane surface (face) as in prior art lamps, the outer peripheral region or rim of the window, together with the window to metal bond, is compressively loaded, with consequent reduction of tensile stresses. Since the ultimate yield strength for sapphire in compression far exceeds that in tension, this seal has been found to withstand much higher internal pressures than the prior art peripheral seals for equal thickness sapphire windows. Whereas the prior art peripheral seals have been tested to seal failure at 1200 psi, the compressive window seal of the present invention has not been observed to fail at 1900 psi. It is conjectured that exposure of the circumferential surface 19 of the window to internal gas pressure of the lamp results in a compressive stress across the diameters of the window, resulting in the higher observed resistance to fracture. It is also noted that the braze bond between the window 11 and the sealing ring 21 is in compression due to the high internal gas pressure. Thus higher pressures may be achieved, or alternatively, a thinner sapphire window may be employed to maintain the same structural integrity as characterized by the prior art.

A second electrode, here anode 22, is supported in the rear of the lamp. Surrounding and attached to anode 22 is a high strength metal alloy shell 28. Rear and front shells comprising the lamp envelope are connected by attaching metal shells 18 and 28 to an insulating ring 25 of high strength ceramic. Sealing rings 29 of, for example, Kovar, are used to seal the ceramic ring 25 to anode shell 28 and cathode shell 18, thereby forming a hermetic envelope. The cathode shell 18 and the anode shell 28 are mutually configured to place ceramic ring 25 in compression and to shield ceramic ring 25 from contamination and impact. This is accomplished by forming on cathode shell 18 an inward projecting flange 30, and by forming on anode shell 28 an outward projecting flange 32. These flanges overlap each other to intercept a common radial region defined from center line 34; and it is this common radial region, which is occupied by ceramic ring 25. The internal pressure thus tends to hold the envelope together. The exterior overlap of cathode shell 18 over the ceramic ring 25 tends to thus protect the ceramic ring 25 from contamination, which could promote short circuits, and from impacts, which could damage it. Should the ceramic ring 25 fail, fragments are likewise prevented from causing damage to nearby personnel or apparatus. Moreover should the ceramic insulator ring 25 or its seals fail, the cathode and anode shells 18 and 28 are prevented from separating by the flanges 30 and 32.

The ratio of compressive strength to tensile strength for a typical ceramic as employed here is in excess of 10:1; therefore the ceramic insulator can withstand much higher compressive stresses arising from the high pressure gas filling of the lamp than would be the case were the ceramic to be tensile loaded.

It will be observed that preparation of ceramic ring 25 for brazing requires only grinding of the end plane surfaces rather than the more elaborate requirements for preparation of radial surfaces for brazing. Similarly, only plane surfaces (of flanges 30 and 32) need be prepared for brazing rather than circumferential surfaces of shells 18 and 28. The seals are knife-edge brazements which are subject to substantially purely compressive stresses.

Figure 3:
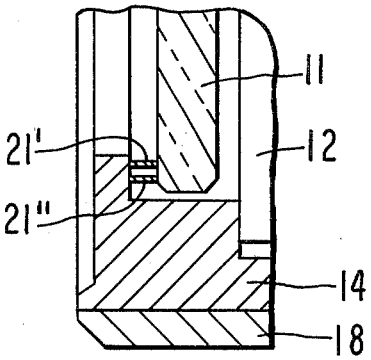
FIG. 3 is a detail of an alternate embodiment of the window seal of the present invention.
Figure 2:
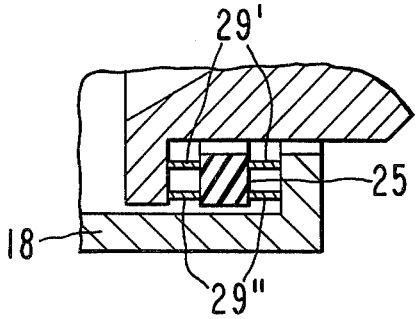
FIG. 2 is a detail of an alternate embodiment of the main body seal of the present invention.

FIG. 2 is an alternate seal wherein two coaxial rings 29' and 29'' are employed in place of the single ring 29. Similarly, dual sealing rings are illustrated in FIG. 3 for an alternate arrangement to seal the window 11 to the assembly ring 14.

Assembly of the lamp of FIG. 1 is accomplished by first performing the brazing operations required to seal cathode shell 18 to anode shell 28. The assembly ring 14 supporting the window 11 and the cathode 10 is brazed to the cathode shell 18 as the last braze. The lamp is then filled to high pressure through port 36, preferably with xenon, and the port 36 is then sealed off.

Since changes could be made in particular details of the embodiment of the invention disclosed herein without departing from the scope of the invention, it is intended that the above description and accompanying drawings be interpreted as illustrative only and not as limiting.

What is claimed is:

1. An envelope for an arc lamp, said envelope being capable of containing a gas therewithin at a pressure higher than atmospheric pressure, said envelope comprising:

a first metallic member having an inwardly projecting flange portion, a second metallic member having an outwardly projecting flange portion, the outwardly projecting flange portion of said second metallic member being received within said first metallic member, the inwardly projecting flange portion of said first metallic member being disposed to overlap the outwardly projecting flange portion of said second metallic member, said overlapping flange portions of said first and second metallic members being radially spaced apart to define a generally annular region between said first and second metallic members, a ceramic member disposed in said annular region, and means for hermetically sealing said ceramic member to said inwardly and outwardly projecting flange portions so that said ceramic member is under compression when said envelope contains a gas at a pressure higher than atmospheric pressure.

2. The arc lamp envelope of claim 1 wherein said sealing means comprises a first seal interposed between a first surface portion of said ceramic member and the outwardly projecting flange portion of said second metallic member, and a second seal interposed between a second surface portion of said ceramic member and the inwardly projecting flange portion of said first metallic member.

3. The arc lamp envelope of claim 2 wherein said first and second surface portions of said ceramic member are planar, and wherein each of said first and second seals comprises a metallic alloy member formed to a knife-edge seal.

4. The arc lamp envelope of claim 3 wherein said planar surface portions of said ceramic member are metallized, and wherein said first and second knife-edge seals are brazed, respectively, to said first and second metallized surface portions of said ceramic member.

5. The arc lamp envelope of claim 4 wherein said first and second knife-edge seals are brazed, respectively, to the flanged portions of said second and first metallic members.

6. The arc lamp envelope of claim 2 wherein said ceramic member is of annular configuration surrounding a nonflanged portion of said second metallic member and is contained within said first metallic member.

7. The arc lamp envelope of claim 6 wherein said annular ceramic member is spaced apart from said first and second metallic members.

8. The arc lamp envelope of claim 6 wherein a first surface portion and a second surface portion of said annular ceramic member are planar, said planar surface portions being metallized, and wherein each of said first and second seals comprises a metallic alloy member formed to a knife-edge seal, said first and second knife-edge seals being brazed, respectively, to said first and second metallized surface portions of said ceramic member.

9. The arc lamp envelope of claim 8 wherein said first and second knife-edge seals are brazed, respectively, to the flanged portions of said second and first metallic members.

10. In an arc lamp comprising a metallic envelope member and a window, an outer surface of said window being a portion of the exterior of an enclosure for containing a gas at higher than atmospheric pressure, sealing means for providing a hermetic seal between said metallic envelope member and said window, said sealing means comprising:

a knife-edge member disposed between said metallic envelope member and said window, said knife-edge member being in contact with said window only where a first edge of said knife-edge member abuts a peripheral portion of the outer surface of said window, said window being spaced apart from said metallic envelope member, a second edge of said knife-edge member abutting an inwardly projecting flange portion of said metallic envelope member.

11. The sealing means of claim 10 wherein said peripheral portion of the outer edge of said window is metallized, and wherein said first edge of said knife-edge member is brazed thereto.

12. The sealing means of claim 10 wherein said second edge of said knife-edge member is brazed to said inwardly projecting flange portion of said metallic envelope member.

13. The sealing means of claim 11 wherein the outer surface of said window is generally circular, and wherein said knife-edge member is of annular configuration.

14. The sealing means of claim 11 wherein said knife-edge member is made of Kovar alloy.

* * * * *